US005258080A

United States Patent [19]

Bürger et al.

[11] Patent Number: 5,258,080

[45] Date of Patent: Nov. 2, 1993

[54] NON-ORIENTED ELECTRICAL STRIP AND PROCESS FOR ITS PRODUCTION

[75] Inventors: Rolf Bürger; Gert Lehmann, both of Dresden; Wolfgang Lindner, Grumbach; Harry Wich; Jochen Wieting, both of Dresden, all of Fed. Rep. of Germany

[73] Assignee: EBG Gesellschaft fur Elektromagnetische Werkstoffe, Bochum, Fed. Rep. of Germany

[21] Appl. No.: 622,259

[22] Filed: Dec. 4, 1990

[30] Foreign Application Priority Data

Dec. 6, 1989 [DD] German Democratic Rep. ..... 3352907

[51] Int. Cl.[5] ..... C22C 38/02; C22C 38/06

[52] U.S. Cl. ..... 148/307; 148/308

[58] Field of Search ..... 148/307, 308, 309; 420/103

[56] References Cited

U.S. PATENT DOCUMENTS 3,034,935 5/1962 Walter et al. ..... 148/309
3,971,678 7/1976 Vlad ..... 148/308
4,204,890 5/1980 Irie et al. ..... 148/307
4,946,519 8/1990 Honda et al. ..... 420/103

FOREIGN PATENT DOCUMENTS 55-158252 12/1980 Japan ..... 148/307

*Primary Examiner*—George Wyszomierski
*Attorney, Agent, or Firm*—Sprung Horn Kramer & Woods

[57] ABSTRACT

The invention relates to a non-oriented electrical strip having high proportions of cube or cube on face texture, a polarization of J 2500 > 1.7 T and a low core loss, and also to a process for its production. A steel slab, containing max. 0.025% C, less than 0.1% Mn, 0 to 0.15% boundary-surface-active elements and Si and Al in such a way that the relations (% Si)+2(% Al) > 1.6% and (% Si)+(% Al) < 4.5% are met, balance iron, is hot rolled to a thickness not lower than 3.5 mm. The resulting hot rolled strip is then cold rolled with a degree of reduction of at least 86% without intermediate recrystallization annealing and, if necessary, final annealed.

9 Claims, No Drawings

NON-ORIENTED ELECTRICAL STRIP AND PROCESS FOR ITS PRODUCTION

The invention relates to non-oriented electrical strip having a cube texture (100)<001> or having a cube on face texture (100) <0Vw> and a final thickness of approximately 0.35 to 0.65 mm, and also to a process for its production. Independently of its crystallographic texture, the term "non-oriented electrical strip" is taken in this context to mean such a strip to DIN 46 400 Part 1 or 4, whose loss isotropy does not exceed the maximum values set forth in DIN 46 400 Part 1.

The terms "electrical strip" and "electrical sheet" are here used synonymously. Unless otherwise stated, all statements of percentages means percentages by weight. "J 2500" designates in the following description the magnetic polarization at a magnetic field strength of 2500 A/m and "P 1.5" the core loss at a polarization of 1.5 T (Telsa) and a frequency of 50 Hz.

In the case of the cube texture the electrical strip according to the invention has excellent magnetic properties in the longitudinal and transverse directions, e.g., J 2500>1.7 T and P 1.5<3.3 W/kg for a steel having an average alloying content of (% Si)+(% Al)=1.8%, so that it is more particularly suitable for electromagnetic circuits which are magnetized principally in two directions perpendicular to one another, e.g. for small transformers, power supply units and the stator laminations of large generators.

In the case of the cube on face texture, the electrical strip or sheet according to the invention is substantially isotropic in its plane and has good properties in all directions, e.g., J 2500>1.7 T and P 1.5<3.3 W/kg, and is therefore more particularly suitable for electromagnetic circuits which are magnetized in all directions, e.g., for electric motors and generators.

Processes are known for the production of electrical sheets having cubic textures with (100) faces in the plane of the sheet which have a high magnetic polarization. However, hitherto their commercial production has not been widely adopted, due to production difficulties and high costs.

The production of electrical sheets having a cube texture as a soft magnetic material was mainly investigated as a core material for electric motors and transformers between 1950 and 1970.

In the process known from German patent 1 923 581 the starting material, a slab, having the usual silicon and/or aluminium contents, but low carbon contents (<0.005%, preferably <0.003%) is hot rolled to a thickness of 10 mm and cold rolled in three stages to 0.35 mm with two intermediate annealings. Due to the intermediate annealings, that process is expensive. According to German Offenlegungsschrift 1 966 686, a slab having an additionally limited sulphur content (0.005%, preferably 0.003%) is hot rolled to 5 mm, cold rolled to approximately 1 mm, given an intermediate annealing in dry $H_2$ between 900° and 1050° C., cold rolled to 0.35 mm and finally given a final annealing in a non-oxidizing atmosphere between 1000 ° and 1100° C. By that process it was impossible to produce commercially electric strips exceeding the typical properties of an electric sheet grade to DIN 46 400 Part 1 having the same alloying content and the same thickness.

In another process, disclosed in German Offenlegungsschrift 3 028 147, for the cold rolling of a silicon steel strip, to achieve a considerable reduction in thickness by cold rolling a recovery annealing is interposed to reduce residual stresses, without the magnetic properties of the finished strip being altered thereby. In that process a hot rolled strip having a thickness of 1.52 to 4.06 mm is cold rolled to an intermediate thickness of 0.51 to 1.01 mm and then finish cold rolled to 0.152 to 0.457 mm.

Clearly, a high total degree of deformation cannot be achieved with cold rolling up to 90% without a recovery annealing between the cold rolling steps. However, that process does not relate to special alloys but is propagated for grain-oriented electric sheets (Goss texture), as is made clear by the examples. No indications are given that good magnetic properties can be achieved in the transverse direction also.

The invention relates to the problem of providing a non-oriented electrical strip having the following properties:

- high magnetic polarization values of J 2500>1.7 T by the formation of suitable texture components, and at the same time
- a low core loss of, e.g., P 1.5<3.3 W/kg for a steel having an average alloying content of (% Si)+(% Al)=1.8%.

This problem is solved according to the invention by a non-oriented electrical strip having high proportions of cube or cube on face texture, a polarization of J 2500>1.7 T and low core loss, which is made from a steel having

- ≦0.025% C,
- <0.10% Mn,
- 0.1 to 4.4% Si and
- 0.1 to 4.4% Al, on condition that the following relations are met:

(% Si)+2(% Al)>1.6% and (% Si)+(% Al)<4.5% balance iron, including unavoidable impurities.

Preferably the silicon content is in the range of 0.5 to 4.0%, more particularly in the range of 0.5 to 2.0%. While a substantial freedom of alpha-gamma-transformation of the steel was determined by the choice of the steel composition according to the invention with (% Si)+2(% Al)>1.6%, advantageously the steel slab contains silicon and aluminium in a quantity such that the relation (% Si)+2(% Al)>2% is met. Aluminium is preferably in the range of 0.3 to 2.0%.

It has surprisingly been found that low manganese contents of less than 0.1%, preferably less than 0.08% Mn, are required for the adjustment of the (100) texture components.

If the composition according to the invention is maintained, the hot rolled strip develops a layered structure with a recrystallized structure in zones adjacent the surface having mainly (110)<001> and $(11\bar{2})$<111 >, and in the interior of the strip a polygonized structure with elongate larger grains, mainly of the stable orientation (100)<011> and $(11\bar{1})$ <112 >.

The carbon content should conveniently be limited to a maximum of 0.015% and is preferably between 0.001 and 0.015%. This low initial carbon content is inter alia advantageous as regards the duration of the decarburization annealing to obtain an ageing-free electrical strip or sheet having a carbon content of less than 0.002%, since the extra advantageous addition of boundary-surface-active elements such as, for example, antimony and/or tin results in the decarburization reaction being appreciably delayed.

Furthermore, the limitation of the carbon content to a maximum of 0.015%, more particularly in conjunction with the adjustment of the silicon and aluminium content to (% Si)+2(% Al)>2%, ensures a complete freedom of transformation of the steel, something which is particularly advantageous for the required properties of the electrical strip or sheet. The freedom of alpha-gamma-transformation of the steel is important for the final annealing, since if the alpha/gamma phase limit is exceeded the adjusted texture is lost, and for the hot deformation, since the ferritic single-phase zone is necessary for the purposeful formation of cubic textural components during hot rolling.

The addition of the boundary-surface-active elements, like antimony and/or tin, in total quantities of 0.005 to 0.15%, preferably 0.02 to 0.04%, leads in the final annealing to the suppression of the growth of grains having undesirable (111) textural components. This is more particularly advantageous for prolonged annealings in batch annealing furnaces or furnaces for the annealing of punched laminations for the processing of semi-processed electrical strip.

The process according to the invention for the production of a non-oriented electrical strip having high proportions of cube or cube on face texture, a polarization of J 2500>1.7 T and a low core loss, consisting of a steel containing

≦0.025% C,

<0.10% Mn, 0.1 to 4.4% Si, 0.1 to 4.4% Al on condition that the following relations are met:

(% Si)+2(% Al)>1.6% and (% Si)+(% Al)<4.5%, balance iron, including unavoidable impurities is characterized in that the steel slab is hot rolled to a thickness not lower than 3.5 mm, whereafter the resulting hot rolled strip is cold rolled with a reduction of at least 86% without recrystallizing intermediate annealing and the cold rolled strip is annealed.

Due to the steel composition according to the invention, substantially no alpha-gamma-phase transformation takes place as already mentioned, and this is important, since if the alpha/gamma phase limit were to be exceeded the texture produced would be lost and is also important for the hot deformation, since the ferritic single-phase zone is necessary for the purposeful formation of cubic textural components during hot rolling. The cold reduction according to the invention, with a minimum degree of total reduction of 86%, avoiding intermediate recrystallization annealing, also contributes appreciably towards the formation of cubic textural components during the course of the primary recrystallization and normal grain growth.

According to a preferred feature of the process, conveniently reduction in the finishing train during hot rolling is max. 30% per pass if the slab temperature is in the range between 1000° and 1060° C. The final rolling temperature should preferably be between 900° and 960° C., since the aforementioned layered structure is encouraged thereby.

According to another advantageous feature of the process, a first stage of the cold rolling is performed up to a strip thickness of 1.3 to 1.9 mm at an elevated temperature of 180° to 300° C. In combination with a carbon content of below 0.025%, especially below 0.015%, according to the present invention the dynamic reduction ageing due to the carbon-dislocation-interaction a blockade or anquoring slidable dislocations and thereby an activation of other sliding systems or inhomogeneous deformation (shearing bands) is achieved which contribute to an increase of the magnetic polarization in a transverse direction.

According to a further feature of the process according to the invention, improved isotropy of the magnetic properties in the plane of electrical strip with cube on face texture can be obtained by the features that with a strip thickness which is still 1.12 to 1.2 times the final thickness, the cold rolled strip is subjected to a non-recrystallizing recovery annealing, more particularly at between 400° and 500° C. for 1 to 10 hours, whereafter it is finish cold rolled and annealed. The resulting sheet is more particularly suitable for rotary machines.

To produce a fully processed strip, the strip cold rolled to final thickness is given if necessary, a preliminary decarburization annealing in a continuous furnace, and then final annealed in the same furnace at a temperature between 900° and 1100° C. The final annealing temperature should not be lower than 900° C., since otherwise the grain size of the material will not be large enough to obtain a low core loss.

To produce a semi-processed strip the cold rolled strip is annealed with recrystallization in a batch annealing furnace in a hydrogen atmosphere between 600° to 900° C. or in a continuous furnace between 750° to 900° C. for less than 5 minutes. In the case of batch annealing, the strip must then be lavelled or skin pass rolled with a degree of reduction of less than 7%. From the resulting strips, which are not given a final annealing, laminations are then produced in the usual manner and annealed, for example, according to DIN 46 400 Part 4. However, to obtain particularly good magnetic properties, the duration and temperature of the lamination annealing should be increased to, for example, 15 hours and 950° C. in the case of steel compositions having boundary-surface-active elements.

The invention will now be described with reference to the following Examples.

EXAMPLE 1

The starting material used was 8 hot rolled strips of different compositions and strip thicknesses (Table 1). These were cold rolled to 0.5 mm, then decarburized at 840° C. and annealed for 1 hour at 950° C. The magnetic result is shown in Table 2.

TABLE 1

| Hot strip | % Si | % Al | % Mn | % P | % C | % S | % Sb | strip thickness (mm) |
|---|---|---|---|---|---|---|---|---|
| A | 0.60 | 0.60 | 0.04 | 0.013 | 0.008 | 0.012 | — | 5.0 |
| B | 0.90 | — | 0.02 | 0.013 | 0.005 | 0.011 | — | 5.0 |
| C | 1.26 | 0.13 | 0.23 | 0.044 | 0.007 | 0.007 | — | 5.0 |
| D | 1.79 | 0.36 | 0.24 | 0.009 | 0.007 | 0.005 | — | 5.0 |
| E | 1.04 | 0.70 | 0.05 | 0.008 | 0.009 | 0.002 | — | 5.0 |
| F1 | 1.04 | 0.68 | 0.05 | 0.010 | 0.016 | 0.003 | 0.04 | 3.5 |
| F2 | 1.04 | 0.68 | 0.05 | 0.010 | 0.016 | 0.003 | 0.04 | 4.0 |
| F3 | 1.04 | 0.68 | 0.05 | 0.010 | 0.016 | 0.003 | 0.04 | 4.5 |

TABLE 2

| Hot strip | J 2500 long. (T) | J 2500 transverse (T) | P 1.5 mixed*) (W/kg) |
|---|---|---|---|
| A | 1.75 | 1.70 | 3.3 |
| B | 1.60 | 1.54 | 3.9 (comparison) |
| C | 1.68 | 1.66 | 4.4 (comparison) |
| D | 1.62 | 1.61 | 3.5 (comparison) |
| E | 1.74 | 1.73 | 2.6 |
| F1 | 1.70 | 1.70 | 2.9 |
| F2 | 1.71 | 1.70 | 3.0 |
| F3 | 1.73 | 1.72 | 2.8 |

*)Strips are sheared 50% longitudinally and 50% transversely to rolling direction.

The strips B, C and D are comparison examples not belonging to the invention. The silicon and aluminium contents of strips B and C do not meet the relation (% Si)+2(% Al)>1.6. Strips C and D have too high a manganese content.

EXAMPLE 2

The hot rolled strips A and E shown in Table 1 were rolled in three variants:

a) cold rolling to a strip thickness of 0.5 mm
b) preheating of the hot rolled strip to 230° C. and cold rolling at the same temperature to 1.5 mm, followed by finish rolling to 0.5 mm final thickness.
c) as (b), but with a recovery annealing 480° C./4 hours at an intermediate thickness of 0.58 mm.

Then the strips were decarburized and annealed for 1 minute at 1050° C. (hot rolled strip E, Table 3) and 1 hour at 950° C. (hot rolled strip A, Table 4) respectively.

TABLE 3

| Hot strip | Rolling variant | J 2500 long. (T) | J 2500 trans. (T) | P 1.5 mixed*) (W/kg) |
|---|---|---|---|---|
| E | a | 1.72 | 1.70 | 3.3 |
| | b | 1.73 | 1.72 | 3.5 |

*)Strips are sheared 50% longitudinally and 50% transversely to rolling direction.

TABLE 4

| Hot strip | Rolling variant | Angle to rolling direction 0° | 22.5° | 45° | 67.5° | 90° |
|---|---|---|---|---|---|---|
| | | J 2500 (T) | | | | |
| A | a | 1.75 | 1.69 | 1.61 | 1.65 | 1.70 |
| | b | 1.80 | 1.73 | 1.65 | 1.71 | 1.79 |
| | c | 1.71 | 1.70 | 1.69 | 1.69 | 1.70 |

With brief annealing (Table 3) variant (b) produces a slight improvement in polarization, which becomes even more clearly recognizable after prolonged annealing (Table 4). The substantially identical values in the longitudinal (0°) and transverse direction (90°) indicate a particularly high proportion of grains with cube orientation.

A marked isotropy of polarization in the plane of the sheet can be obtained by variant (c).

EXAMPLE 3

The hot rolled strips E and F3 shown in Table 1 were preheated to 230° C., rolled at this temperature to 1.5 mm, then finish rolled to 0.5 mm. After decarburization at 840° C., an annealing was performed in three variants:

a) 1 minute at 1050° C.
b) 1 hour at 950° C.
c) 15 hours at 950° C.

Variant (a) is required for the production of an electric sheet given a final annealing; variants (b) and (c) represent the lamination annealing of a semi-processed sheet.

Table 5 shows the effect of the annealing variants on the magnetic result.

TABLE 5

| Hot strip | Annealing variant | J 2500 long. (T) | J 2500 trans. (T) | P 1.5 mixed*) (W/kg) |
|---|---|---|---|---|
| E | a | 1.73 | 1.72 | 3.4 |
| | b | 1.77 | 1.77 | 2.7 |
| | c | 1.74 | 1.73 | 3.0 |
| F3 | a | 1.73 | 1.73 | 3.4 |

TABLE 5-continued

| Hot strip | Annealing variant | J 2500 long. (T) | J 2500 trans. (T) | P 1.5 mixed*) (W/kg) |
|---|---|---|---|---|
| | b | 1.76 | 1.77 | 2.9 |
| | c | 1.77 | 1.79 | 2.6 |

*)Strips are sheared 50% longitudinally and 50% transversely to rolling direction.

In variant (c) a clearly higher polarization is obtained in the hot rolled strip F3 by the addition of antimony than in the hot rolled strip E without antimony.

EXAMPLE 4

A melt was processed to give hot rolled strip (composition in Table 6).

TABLE 6

| Alloy | % Si | % Al | % Mn | % Cr | % Cu | % P | % C | % S |
|---|---|---|---|---|---|---|---|---|
| G | 0.93 | 0.64 | 0.01 | 0.03 | 0.04 | 0.005 | 0.001 | 0.015 |

The finish rolling of the hot rolled strips to a strip thickness of 4.8 mm was performed at two different final rolling temperatures:

a) final rolling temperature: 920° C.
b) final rolling temperature: 850° C.

Then the hot rolled strips were equally cold rolled to a final thickness of 0.5 mm, decarburized and annealed for 1 hour at 950° C. The result is shown in Table 7.

TABLE 7

| Alloy | Rolling variant | J 2500 long. (T) | J 2500 trans. (T) | P 1.5 mixed*) (W/kg) |
|---|---|---|---|---|
| G | a | 1.78 | 1.77 | 2.9 |
| | b | 1.72 | 1.68 | 3.8 |

*)Strips are sheared 50% longitudinally and 50% transversely to rolling direction.

The final rolling temperature of variant (a) lies in the preferred range of 900° to 960° C. and therefore leads to an appreciably higher polarization.

We claim:

1. A non-oriented isotropic electrical strip having high proportions of cube or cube on face texture, a polarization of J 2500>1.7 T and a low core loss, consisting of a steel containing
≦0.025% C,
<0.10% Mn,
0.1 to 4.4% Si,
0.1 to 4.4% Al, on condition that the following relations are met:
(% Si)+2(% Al)>1.6% and
(% Si)+(% Al)<4.5%,
balance iron, including unavoidable impurities.

2. An electrical strip according to claim 1, alloyed with 0.5 to 4.0% Si.

3. An electrical strip according to claim 1, alloyed with 0.5 to 2.0% Si.

4. An electrical strip according to claim 1, alloyed with 0.3 to 2.0% Al.

5. An electrical strip according to claim 1, alloyed with a quantity of Si and Al such that the relation (% Si)+2(% Al)>2% is met.

6. An electrical strip according to claim 5, alloyed with not more than 0.015% C.

7. An electrical strip according to claim 1, alloyed with less than 0.08% Mn.

8. An electrical strip according to claim 1, alloyed with 0.001 to 0.015% C.

9. An electrical strip according to claim 1, alloyed with a total of 0.005 to 0.15% Sn and/or Sb as boundary-surface-active elements.

* * * * *